United States Patent [19]

Sinkovitz

[11] 4,222,901

[45] Sep. 16, 1980

[54] ELECTROCONDUCTIVE POLYMERS HAVING IMPROVED SOLVENT HOLDOUT PROPERTIES

[75] Inventor: Gloria D. Sinkovitz, Bridgeville, Pa.

[73] Assignee: Calgon Corporation, Pittsburgh, Pa.

[21] Appl. No.: 960,806

[22] Filed: Nov. 15, 1978

[51] Int. Cl.[2] ..... H01B 1/00

[52] U.S. Cl. ..... 252/500; 162/137; 162/138; 428/500; 428/511; 430/62; 525/293; 525/300

[58] Field of Search ..... 252/500; 96/1.5

[56] References Cited

U.S. PATENT DOCUMENTS

| | | | |
|---|---|---|---|
| 2,923,701 | 2/1960 | Schuller | 260/85.5 |
| 3,544,318 | 12/1970 | Boothe | 96/1.5 |
| 3,887,496 | 6/1975 | Cornier | 252/500 |
| 4,132,674 | 1/1979 | Hwang | 252/500 |

*Primary Examiner*—Benjamin R. Padgett
*Assistant Examiner*—J. L. Barr
*Attorney, Agent, or Firm*—Mario A. Monaco; Martin L. Katz

[57] ABSTRACT

Electroconductive copolymers of diallyldimethylammonium chloride and at least 15 percent by weight acrylamide which exhibit improved solvent holdout.

4 Claims, No Drawings

ELECTROCONDUCTIVE POLYMERS HAVING IMPROVED SOLVENT HOLDOUT PROPERTIES

This invention relates to a process and composition which provides improved solvent holdout properties for electroconductive coating formulations used in the manufacture of electroconductive papers.

More particularly, this invention relates to a process and composition in which copolymers of quaternary ammonium electroconductive resins and at least 10 percent by weight acrylamide are utilized to improve the solvent holdout properties of electroconductive coating formulations utilized in the manufacture of electroconductive paper. Included in such cationic polymers are those of the formula:

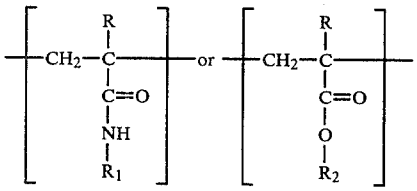

wherein:

R stands for hydrogen or lower alkyl;

$R_1$ represents a member of the class composed of

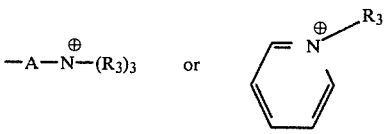

$R_2$ stands for

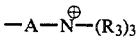

wherein, in turn, A represents a lower alkylene, an hydroxy-lower alkylene or lower- alkyl-substituted lower alkylene group, and $R_3$ stands for a lower alkyl group. These polymers include those wherein the quaternary ammonium functional group is carried as a pendant group to the principal polymer chain, such as, for example, polyvinyl benzyl trimethyl ammonium chloride, poly-[alpha-(methylene trimethyl ammonium chloride)ethylene oxide] and poly(methacryloloxyethyl trimethyl ammonium chloride). Also useful are those polymers wherein the quaternary ammonium functional group is incorporated in a cyclic structure which comprises a portion of the polymer backbone, such as, for example, polymers containing repeating units of the formula:

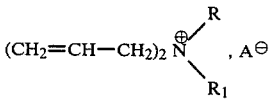

where R is an alkyl group of 1 to 18 carbon atoms and $R_1$ is R or $\beta$-propionamido and A is an anion. A preferred polymer of this class is poly-(dimethyldiallyl ammonium chloride); and those wherein the quaternary ammonium functional group forms a part of the polymer chain, such cationic polymers being commonly designated as, "ionenes."

The polymers of the present invention described above are used to prepare electroconductive paper. Electroconductive paper may be used to distribute electrical stresses in various insulating products; see U.S. Pat. No. 3,148,107. Where electrically conductive paper is to be used for nonimpact printing, a substrate, backing, impregnation coating, or layer of electrically conductive material is usually constructed. See Vaurio and Fird, "Electrically Conductive Paper for Nonimpact Printing," TAPPI, December 1964, vol. 47, No. 12, pp. 163A–165A. Various types of nonimpact printing processes are known, such as electrostatographic, electrophotographic, electrographic, Electrofax® and other processes. The polymers of the present invention are also useful in preparing electroconductive papers used in dielectric processes. See U.S. Pat. Nos. 3,709,728 and 3,779,982. As a rule, such processes call for the placement of an electric charge on the paper, which may be accomplished by a corona discharge in copiers or by charged stylii in pulsed printers and plotters. The charge is, in some processes, placed on the paper in darkness. The paper also contains an insulating or dielectric layer or material which causes the charge to be dissipated in an area where light strikes it, thus leaving a pattern of the charged areas which is a reproduction of the image desired. The charged area attracts a powdered or other usually particulated image-forming material which may be fused or otherwise treated to make the image permanent. Other dielectric processes differ in that the image is created by electrical dissipation of the static charge in nonimage areas; in this and other processes (see Vaurio and Fird, supra), the common characteristic is an electrically conductive base paper.

Probably the most common system at present is the direct electrostatic process; see "Chemical & Engineering News," July 20, 1964, pp 88–89; U.S. Pat. No. 3,052,539. This process is similar to the xerographic method of copy reproduction; however, the conductive substrate is built into the paper rather than being on a separate drum or other device.

Among the desirable characteristics of an electrically conductive material for use in nonimpact printing are whiteness and stability of conductivity over a wide range of relative humidity. Various inorganic additives have been rejected or criticized by workers in the art because of their excessive weight and/or objectionable color as well as their poor tolerance of humidity variations.

In addition to their utility in forming the basis for the electroconductive layer of electroconductive paper, the polymers of the present invention also have the important utility of being able to impart improved solvent holdout properties to the electroconductive paper to which they have been applied. Thus, the polymers of the present invention are useful in preparing electroconductive coating formulations with improved solvent holdout imparting properties. Particularly, such formulations may be applied to non-surface sized paper raw stock and the resultant coated paper will have solvent holdout and conductivity that are acceptable for conductive base stocks used in electroconductive paper grades.

In general, electroconductive base sheets for use in the manufacture of electrographic reproduction papers are prepared by applying to one or both surfaces of a suitable paper substrate (a publication grade paper of basis weight in the range of 30 to 45 pounds per 3,000 square feet) a resinous conductive layer to render the paper electroconductive. Commonly the conductive layer comprises an electroconductive polymer either alone or more usually, formulated with a binder (normally a water dispersible, non-conductive film-forming polymer such as a protein, starch, styrenebutadiene latices, a modified or converted starch, casein, polyvinyl acetate, polyvinyl alcohol, and the like), and with a pigment (such as calcium carbonate, kaolin clay, titanium dioxide, alumina or a combination of these materials). In the electrographic reproduction paper industry, such formulations including a conductive agent, a binder and a pigment, are commonly referred to as coating formulations or compositions.

The binders in conventional conductive coating formulations serve to make the paper more porous and more uniform, to improve the adherence of the conductive layer to the base paper and, importantly, to impart the conductive layer the properties of a holdout or barrier coating to prevent solvents employed in the latter applied dielectric or photosensitive layers from penetrating into the conductivized paper. A separate non-conductive solvent holdout layer comprising a mixture of conventional binders is usually applied to the paper prior to the application of the conductive layer in order to assit in achieving a solvent holdout effect. Solvent holdout to both toluene and parafinic solvents is essential because the top side of a conductive base paper comes into contact with toluene during the subsequent application of the dielectric photosensitive coating which comprises dye-sensitized zinc oxide or a dielectric resin dispersed in a solution of toluene and a binder. The back side of the coated base stock (now referred to as finished electrographic paper) comes into contact with kerosene during the copying process (i.e., in Electrofax® copy machines) that use "wet" toners which are comprised of carbon particles suspended in a solution of kerosene and binders. The usual type of electroconductive polymer in combination with the usual type of coating additives, such as the binders and pigments mentioned above, will not give acceptable solvent holdout when applied at commercially feasable coatweights of from 1 to 4 pounds of coating per 3,000 square feet of paper surface where attempts are made to prepare the conductive base sheet in an obviously desirable one-pass process, that is, without pretreatment of the paper raw stock with a separate solvent holdout layer.

The polymers of the present invention are intended for use in electroconductive coating formulations used in multi-pass coating operations. However, it is contemplated that the polymers of the present invention may also be used to prepare coating formulations usable in one-pass coating operations.

Use of the polymers of the present invention thus results in improved electroconductive coating formulations giving conductive base sheet surface resistivity and enhanced solvent holdout properties that are commercially acceptable for the manufacture of electrographic reproduction papers according to current industry standards and practices, when applied to a surface sized raw stock (a raw stock that has received a surface treatment of starch, alginate or other surface sizing material). It is also contemplated that the polymers of the present invention may be used to prepare coating formulations giving acceptable electroconductive paper when applied to non-surface sized raw stock, as well. The improved coating formulations of this invention, therefore, not only provide enhanced solvent holdout properties, but may make possible the application of the electroconductive layer to the base sheet in a one-pass operation, thus eliminating any necessity for the application of separate solvent holdout layers. The surface resistivity and solvent holdout properties obtained through the use of the improved coating formulations of this invention have been confirmed employing standard laboratory techniques. It is contemplated, therefore, that suitable coatweights of the improved coating formulations of this invention will be employed in the manufacture of electroconductive base sheets suitable for the preparation of electrophotgraphic, electrographic, and similar reproduction process papers.

The binders employed in the improved coating formulations of this invention can be of great variety and do not constitute a critical aspect of the instant invention. Any of the water dispersible, non-conductive, film-forming polymers conventionally employed for this purpose may be used in the coating formulations of this invention. Suitable binders will include, for example, polyvinyl alcohols, polyvinyl acetates, styrenebutadiene latices, poly(ethylene-vinyl acetate)copolymers, unmodified starches, acetylated starches, hydroxyethyl starches, enzyme converted starches, oxidized starches, proteins, caseins, and the like or mixtures thereof. Similarly, any of the variety of pigments conventionally employed in coating formulations may be employed in the improved coating formulations of this invention including commercially available calcium carbonates, kaolin clays, titanium dioxides, aluminas or combinations of these materials.

The weight percent (dry coating basis) of the several components in the improved coating formulations of the present invention may vary widely. In general, the electroconductive polymer component will constitute from 15 to 50% by weight of the formulation; the binder will constitute from 30 to 70% by weight of the formulation; and the pigment will constitute from 10 to 60% by weight of the formulation. Such formulations are typical of the coating formulations usually employed in the manufacture of electroconductive base sheets.

The instant invention is based upon the discovery that the solvent holdout of conventional coating formulations can be improved by utilizing copolymers of quaternary ammonium electroconductive resins and at least 5 percent by weight acrylamide. These copolymers exhibit superior solvent holdout properties than the homopolymer or the corresponding physical blend of polymers.

Molecular weights of our polymers are apparently not critical to conductivity. The polymers of our invention may be coated on substrates such as paper and synthetic sustrates, such as polyesters such as polyethylene glycol-terephthalate, nylon, polyethylene and other polyolifins in amounts of from about 0.1 to about 3.0 pounds per 3,000 square feet by conventional coating techniques.

The following examples illustrate the utility of the polymers of the present invention:

EXAMPLE 1

To a one liter flask were added 340.5 g of a 67.4 percent aqueous solution of diallyldimethylammonium chloride, 143.2 g of water, 0.3 g of tetrasodium ethylenediaminetetraacetic acid, and 15.0 g of glycerin. The pH was adjusted to 6.6 with dilute sulfuric acid. The solution was purged with nitrogen for one hour while heating to 100° C. A solution of 2.7 g of ammonium persulfate in 10 g of water was added over three hours. Simultaneously, 88.3 g of a 45.86 percent aqueous solution of acrylamide was added at the following rates. For the first 34 minutes, the rate was 1.4 ml/minute, then 0.70 ml/minute for 30 minutes, then 0.48 ml/minute for 27 minutes, and finally, 4.4 ml/hour for 59 minutes. After all feeds were complete, the reaction was held at reflux for one hour, the 75 ml of water was added and the solution was cooled. The product was a copolymer of 85 percent by weight diallyldimethyl ammonium chloride and 15 percent by weight acrylamide and had a Brookfield viscosity of 3890 cps.

EXAMPLE 2

The polymer obtained from Example 1 was formulated and coated on a good barrier-coated rawstock at ~2# coatweight. The coating formualtion was, on a solids basis:

50 percent —#1 Coating Clay
20 percent —Hydroxyethylated Starch
30 percent —Electroconductive Polymer of Example 1

After drying, the coated sheets were conditioned at approximately 20 percent or 50 percent RH for ~18 hours prior to obtaining conductivity measurements. The conductivity was determined by a standard procedure essentially like that described in ASTM D-257-66, Standard Methods of Test for D-C Resistance or Conductance of Insulating Materials.

Solvent holdout was determined on coated sheets that had been conditioned at 50 percent RH overnight. One-half milliliter (0.5) of a dyed toluene solution (2 percent Flaming Red Dye) is applied to the coated side of the paper for a 10 second contact time. The excess dye solution is wiped off. The degree of penetration is measured on the reverse side and compared to the TAPPI Standard Solvent Holdout-Penetration Chart.

TABLE I

| | Surface Resistivity (ohms/sq.) | | Percent |
|---|---|---|---|
| | 22% RH | 50% RH | Penetration |
| Poly(diallyldimethyl-ammonium chloride) | $3.0 \times 10^8$ | $2.1 \times 10^7$ | 50 |
| Polymer of Example 1 | $9.4 \times 10^8$ | $6.0 \times 10^7$ | 15 |

EXAMPLE 3

The polymer obtained from Example 1 was formulated and coated on a poor and an average grade of barrier coated rawstock at 2# coatweight. On a solids basis, this formulation contained:

45 percent —#Coating Clay
10 percent —Hydroxyethylated Starch
15 percent —Airflex 110
30 percent —Conductive Polymer of Example 1

The paper was coated and conditioned in the same manner as previously described. Conductivity and solvent holdout properties were determined in the same manner as stated in Example 2.

TABLE II

| | Surface Resistivity (ohms/sq.) at 20 Percent RH | | Percent Penetration | |
|---|---|---|---|---|
| | Poor Rawstock | Average Rawstock | Poor Rawstock | Average Rawstock |
| Poly(diallyl-dimethyl-ammonium chloride) | $3.1 \times 10^8$ | $6.3 \times 10^8$ | 100 | 15 |
| Polymer of Example 1 | $1.4 \times 10^9$ | $3.6 \times 10^9$ | 50 | 4 |

EXAMPLE 4

Copolymers of diallyldimethylammonium chloride and acrylamide were compared to the corresponding physical blends by the procedure of Example 2 and the results, as set forth in the following table, demonstrate that the copolymers exhibit superior solvent holdout and slightly lower conductivity than the corresponding blend.

TABLE III

| Composition % DMDAAC/ % AM) | Coat-weight (lbs./ 3000 ft.$^2$) | Coatweight Surface Resistivity (ohms/sq.) | | Percent Penetra-tion |
|---|---|---|---|---|
| | | 50% RH | 18% RH | |
| 85/15 Copolymer | 2.4 | $8.0 \times 10^7$ | $2.3 \times 10^{10}$ | 30 |
| 85/15 Blend | 2.3 | $3.6 \times 10^7$ | $2.4 \times 10^9$ | 95 |
| 80/20 Copolymer | 2.1 | $2.8 \times 10^8$ | $1.7 \times 10^{10}$ | 20 |
| 80/20 Blend | 1.8 | $1.1 \times 10^8$ | $2.7 \times 10^9$ | 95 |
| 70/30 Copolymer | 1.9 | $9.9 \times 10^8$ | $1.0 \times 10^{11}$ | 10 |
| 70/30 Blend | 1.8 | $1.7 \times 10^8$ | $4.1 \times 10^9$ | 80 |

I claim:

1. An improved electroconductive resin coating composition containing a copolymer of a water-soluble quaternary ammonium conductive monomer and at least 15, but less than 30, percent by weight-acrylamide.

2. A composition as in claim 1 wherein the water-soluble quaternary ammonium conductive monomer is vinylbenzyltrimethylammonium chloride or diallyldimethylammonium chloride.

3. A composition as in claim 2 wherein the water-soluble quaternary ammonium conductive monomer is diallyldimethylammonium chloride.

4. An electroconductive article having a substrate and a coating containing from about 0.1 to about 3.0 pounds per 3000 square feet of a copolymer of a water-soluble quaternary ammonium conductive monomer and at least 15, but less than 30, percent by weight acrylamide.

* * * * *